US009840859B2

(12) United States Patent
Hahnenberg et al.

(10) Patent No.: US 9,840,859 B2
(45) Date of Patent: Dec. 12, 2017

(54) SLIDING DOOR FOR MOTOR VEHICLES

(71) Applicant: Ford Global Technologies, LLC, Dearborn, MI (US)

(72) Inventors: Daniel Hahnenberg, Colgne (DE); Thomas Kreuz, Mechernich (DE); Mirko Lehmkuhl, Ratingen (DE); Werner Jakobs, Bergisch Gladbach (DE); Lars Reifenstein, Cologne (DE); Thomas Benderoth, Gummersbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 117 days.

(21) Appl. No.: 14/837,176

(22) Filed: Aug. 27, 2015

(65) Prior Publication Data

US 2016/0083984 A1 Mar. 24, 2016

(30) Foreign Application Priority Data

Sep. 19, 2014 (DE) ..... 10 2014 218 860

(51) Int. Cl.
*E05C 3/06* (2006.01)
*E05C 17/52* (2006.01)
(Continued)

(52) U.S. Cl.
CPC ..... *E05C 17/52* (2013.01); *E05B 81/90* (2013.01); *E05B 83/40* (2013.01); *E05B 85/243* (2013.01);
(Continued)

(58) Field of Classification Search
CPC ..... E05C 17/52; E05C 17/60; E05C 17/46; E05C 17/50; E05C 17/28; E05B 63/145;
(Continued)

(56) References Cited

U.S. PATENT DOCUMENTS 2,168,453 A * 8/1939 Sibley ..... E05C 17/28 292/273
3,164,404 A * 1/1965 Arnold ..... E05C 17/28 292/201
(Continued)

FOREIGN PATENT DOCUMENTS

EP 1617031 A2 1/2006
EP 1717392 A2 11/2006

*Primary Examiner* — Katherine W Mitchell
*Assistant Examiner* — Abe Massad
(74) *Attorney, Agent, or Firm* — Jason Rogers; Price Heneveld LLP

(57) ABSTRACT

A motor vehicle sliding door can be moved by a sliding movement between open and closed positions, wherein, in order to lock the sliding door in the open position, a mechanical door stop in the form of a locking latch which has a receiving region for a catch element of the sliding door is provided, and wherein the locking latch can be released by a motorized actuation device, whereby the catch element is released. In the event of failure of the motorized actuation device of the locking latch, for an intuitive unlocking and locking of the sliding door in the open position thereof may be achieved in that the locking latch has a resiliently loaded overload lever, in that the overload lever forms a lateral portion of the receiving region of the locking latch and in that, when the locking latch is locked, the overload lever can be pivoted outward when a specific pushing force of the sliding door is exceeded.

20 Claims, 2 Drawing Sheets

(51) Int. Cl.

| | |
|---|---|
| ***E05C 17/60*** | (2006.01) |
| ***E05B 81/90*** | (2014.01) |
| ***E05B 83/40*** | (2014.01) |
| ***E05B 85/24*** | (2014.01) |
| *E05B 15/04* | (2006.01) |

(52) U.S. Cl.
CPC ..... *E05C 17/60* (2013.01); *E05B 2015/0482* (2013.01)

(58) Field of Classification Search
CPC .. E05B 65/0835; E05B 65/0858; E05B 81/14; E05F 3/22; E05F 2003/228
See application file for complete search history.

(56) References Cited

U.S. PATENT DOCUMENTS 3,415,562 A * 12/1968 Petersen ..... E05C 17/28 16/48.5
3,729,770 A * 5/1973 Lasier ..... E05C 17/28 16/48.5
4,069,544 A * 1/1978 D'Hooge ..... E05F 3/222 16/48.5
4,286,412 A * 9/1981 Stevens ..... E05C 17/28 292/270
4,506,407 A * 3/1985 Downey ..... E05C 17/28 16/320
5,906,026 A * 5/1999 Junttila ..... E05C 17/28 16/65
2006/0059783 A1* 3/2006 Braun ..... E05B 65/0835 49/360
2006/0254145 A1* 11/2006 Langfermann ..... E05B 63/143 49/279
2012/0181798 A1* 7/2012 Margheritti ..... E05B 77/32 292/200
2012/0299313 A1* 11/2012 Organek ..... E05B 17/007 292/129
2013/0300133 A1* 11/2013 Margheritti ..... E05B 77/34 292/100

* cited by examiner

SLIDING DOOR FOR MOTOR VEHICLES

FIELD OF THE INVENTION

The present invention generally relates to a motor vehicle sliding door which can be moved back and forth by means of a sliding movement between an open and a closed position, wherein, in order to lock the sliding door in the open position thereof, a mechanical door stop in the form of a locking latch which has a receiving region for a catch element of the sliding door is provided, and wherein the locking latch can be released by means of a motorized actuation device, whereby the catch element is released.

BACKGROUND OF THE INVENTION

So-called passive systems by means of which the sliding of a motor vehicle door is secured in the open position thereof after overcoming a mechanical resistance in order to prevent undesirable closure of the sliding door have already been known for a long time. To this end, there is used a mechanical door stop in the form of a locking latch which retains the door in the open position thereof. When the sliding door is intended to be closed again, the operator has to overcome the mechanical resistance in the opposite direction. For example, resiliently loaded stoppers are used as the resistance.

This known passive system is often uncomfortable for the operator since the resistance which is intended to be overcome requires a relatively large application of force. Therefore, there has already been developed a so-called active door stop (EP 1617031 A2 and EP 1717392 A2), in which the locking latch is released by means of an electromotive actuation device so that the sliding door can be readily pushed into the secured position thereof and back again.

Although this active system is comfortable to handle, it has the disadvantage that, for example, in the event of a power failure or a defect in the actuation device between the drive motor and locking latch, the sliding door is blocked in the open position thereof. An interruption of the blocking is possible only via a separate unlocking mechanism, which is complex to operate or which typically can be found only after searching through the operating instructions for the vehicle.

SUMMARY OF THE INVENTION

According to one aspect of the present invention, a motor vehicle sliding door provides a possibility, in the event of failure of the motorized actuation device of the locking latch, of achieving an intuitive unlocking and locking of the sliding door in the open position thereof. The locking latch has a resiliently loaded overload lever, in that the overload lever forms a lateral portion of the receiving region of the locking latch, and in that, when the locking latch is locked, the overload lever can be pivoted outward when a specific pushing force of the sliding door is exceeded.

Therefore, when the motorized actuation device of the locking latch fails, which device is provided per se for easy locking and unlocking of the sliding door in the open position thereof, the sliding door can consequently readily be locked and also unlocked manually by overcoming a specific resistance. The resiliently loaded overload lever which is provided on the locking latch only has to be overcome, without complex considerations being placed upon the operator.

If, therefore, with the sliding door open, the pushing force applied to the sliding door exceeds a specific value in the unlocking direction, the overload lever can pivot outward and in this instance release the sliding door. When the sliding door is opened and is intended to be locked, the overload lever also pivots outward when a pushing force which is applied to the sliding door is exceeded and then pivots as a result of the resilient loading back into the locking position thereof so that the sliding door is locked.

The locking latch is preferably constructed as a rotary latch, whereby relatively simple and reliable construction is possible. The rotary latch can be readily locked by mean of a locking detent in that the rotary movement of the rotary latch is blocked. The locking detent is preferably actuated in an electromotive manner. The locking detent is advantageously pretensioned by means of a locking detent spring in the direction toward the locked position thereof. It is thereby ensured that the locking detent blocks the locking latch in the normal position thereof. An electromotive actuation of the locking detent is then required only to release the locking latch.

The overload lever may be pivotable about an axis which extends transversely through the locking latch. In order to achieve the resilient tension acting on the overload lever, there may be provided a helical or spiral spring which can be readily installed in the smallest space and which produces a reliable pretensioning. The overload lever advantageously has at the side thereof located inside the receiving region an inclined actuation portion for the catch element which is provided on the sliding door. If, therefore, the sliding door is intended to be unlocked with the locking latch blocked, the catch element provided on the sliding door thus presses against the inclined actuation portion of the overload lever, pivots it and is thereby released.

Furthermore, the overload lever has, at the side thereof facing away from the receiving region, an inclined approach portion for the catch element which is provided on the sliding door. When the sliding door is moved into the open locked position, the catch elements strikes this inclined approach portion, thereby lifts the overload lever and then engages in the receiving region of the rotary latch.

The catch element which is provided on the sliding door is preferably constructed as a guiding roller which is round in cross section. The guiding roller is in this instance advantageously rotatably supported so that the locking and unlocking of the sliding door is thereby facilitated. In accordance with the round cross section of the guiding roller, the receiving region of the locking latch, which region serves to lock the guiding roller, may be constructed in the manner of a circular arc. Other forms of the receiving region are also possible in accordance with the respective configuration of the catch element.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 6:
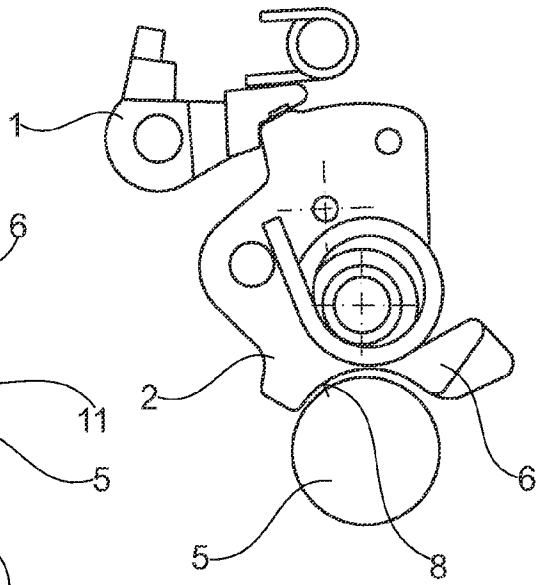
FIG. 6 is a view of the locking latch of FIGS. 4 and 5 in which the catch element of the sliding door assumes the locked position.
Figure 7:
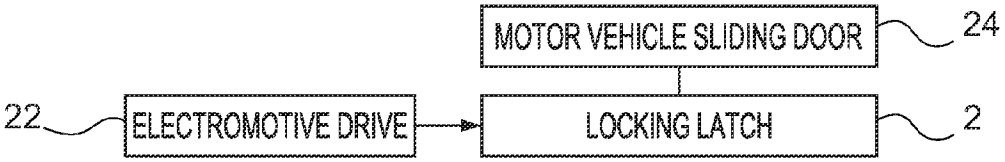
FIG. 7 is a block diagram of a motor vehicle sliding door employing the locking latch.

FIGS. 1-6 of the drawings substantially show the locking latch which is constructed as a rotary latch 2 and which is provided for a motor vehicle sliding door 24 shown in FIG. 7. The rotary latch which can be pushed back and forth by means of a sliding movement between an open and closed position. The rotary latch 2 illustrated in the drawing FIGS. 1-6 serves to lock the sliding door in the open position thereof. In this instance, the rotary latch 2 forms a mechanical door stop and has a receiving region 8 for a catch element of a sliding door. The catch element is in the embodiment illustrated in the drawings constructed as a guiding roller 5 which is round in cross section and which is rotatably supported on the sliding door.

Figure 1:
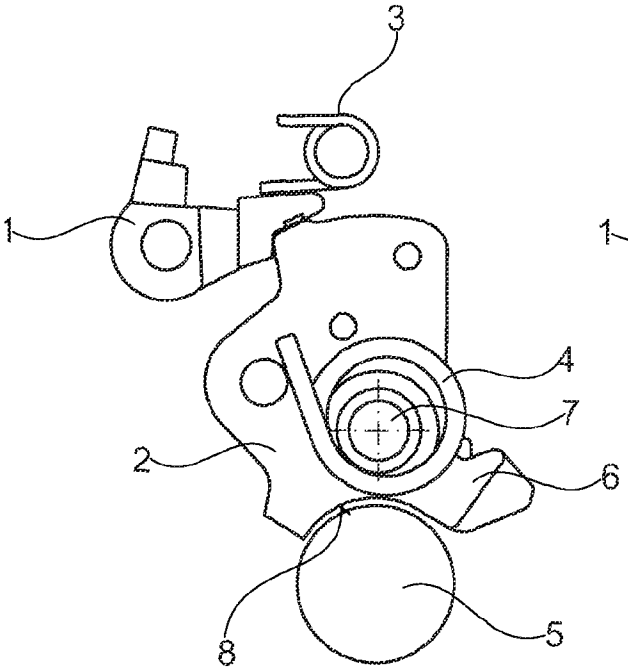
FIG. 1 is a view of the locking latch which is constructed as a rotary latch shown in the locked state.

In FIG. 1 of the drawings, the rotary latch 2 is retained in the locked position thereof by means of a locking detent 1. In the locked position, the guiding roller 5 which is provided on the sliding door is located in the receiving region 8 of the rotary latch 2, whereby a locking of the open sliding door is ensured.

The locking detent 1 can be actuated by means of an electromotive drive 22 which is illustrated in FIG. 7 operatively coupled to the locking latch 2 which, in turn, operates with the motor vehicle sliding door 24. When the locking detent 1 is actuated, the rotary latch 2 is unlocked and can then assume the unlocking position illustrated in FIG. 2. In this position, the sliding door can be comfortably pushed into the locking position and released from it again without a relatively great application of force being required from an operator.

When the sliding door is opened and in order to lock the sliding door in the open position thereof, the guiding roller 5 can be readily introduced in the direction of the arrow 10 into the rotary latch 2. As soon as the guiding roller 5 has reached the receiving region 8 and presses against the left-hand portion of the receiving region 8 in FIG. 2, the rotary latch 2 pivots into the locked position thereof in which the locking detent 1 as a result of a pretensioning applied by the locking detent spring 3 engages in the position illustrated in FIG. 1.

Figure 2:
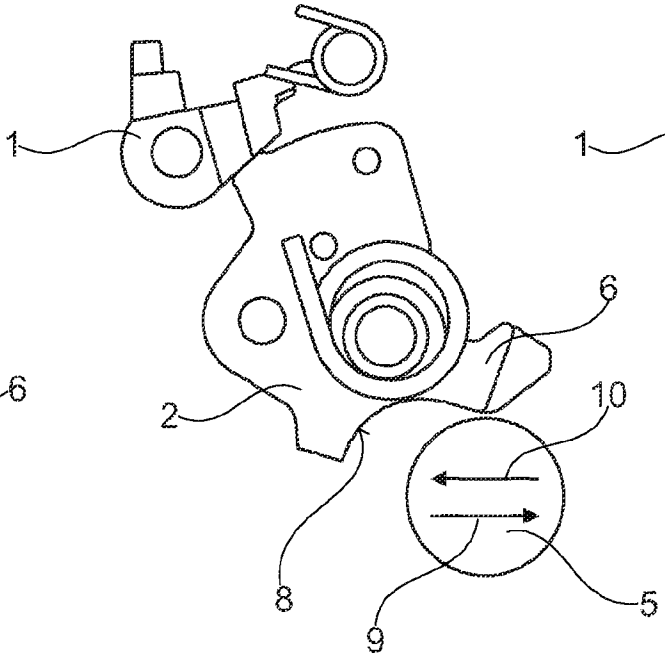
FIG. 2 is a view of the locking latch of FIG. 1, but with the rotary latch shown unlocked.

If the sliding door is subsequently intended to be closed again and has to be unlocked for this purpose, the locking detent 1 is moved via the electromotive drive thereof counter to the force of the locking detent spring 3 into the position illustrated in FIG. 2, in which the guiding roller 5 can be pushed back in the direction of the arrow 9 comfortably and with little application of force into the closed position thereof.

Should the electromotive actuation mechanism ever fail, for example, in the event of a power failure or in the event of mechanical damage of the transmission mechanism between the electromotive drive and the locking detent 1, assistance is provided by the construction of the locking latch, according to the invention.

To this end, there is provided on the rotary latch 2 an overload lever 6 which can be pivoted about an axis 7 which extends transversely through the rotary latch 2. The overload lever 6 forms at the right-hand side of the drawing figures a lateral portion of the receiving region 8 of the rotary latch 2. The overload lever 6 is held by means of an overload spring 4 in the position which is illustrated in FIG. 1 and in which the receiving region 8 maintains a circular-arc form which is adapted to the cross section of the guiding roller 5.

Figure 5:
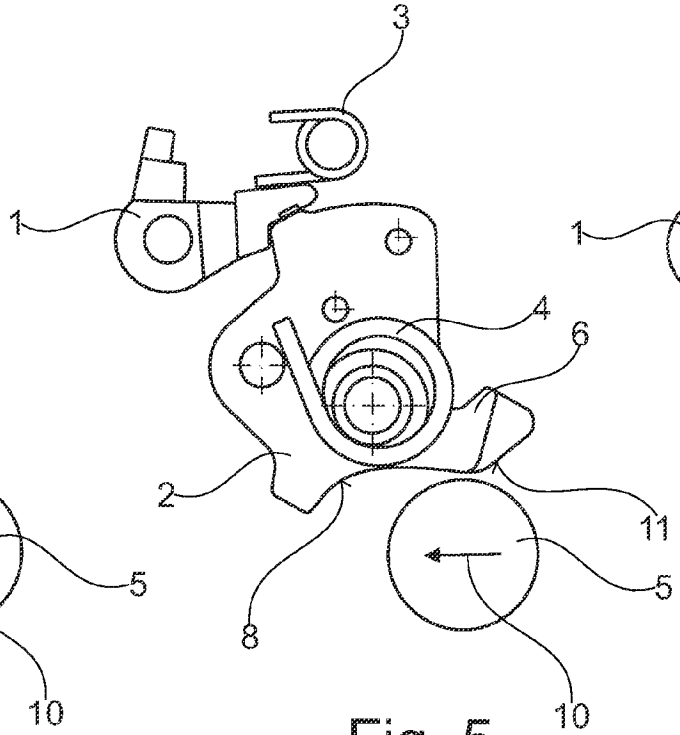
FIG. 5 is a view of the locking latch of FIG. 4, in which the overload lever is raised by the catch element of the sliding door.
Figure 4:
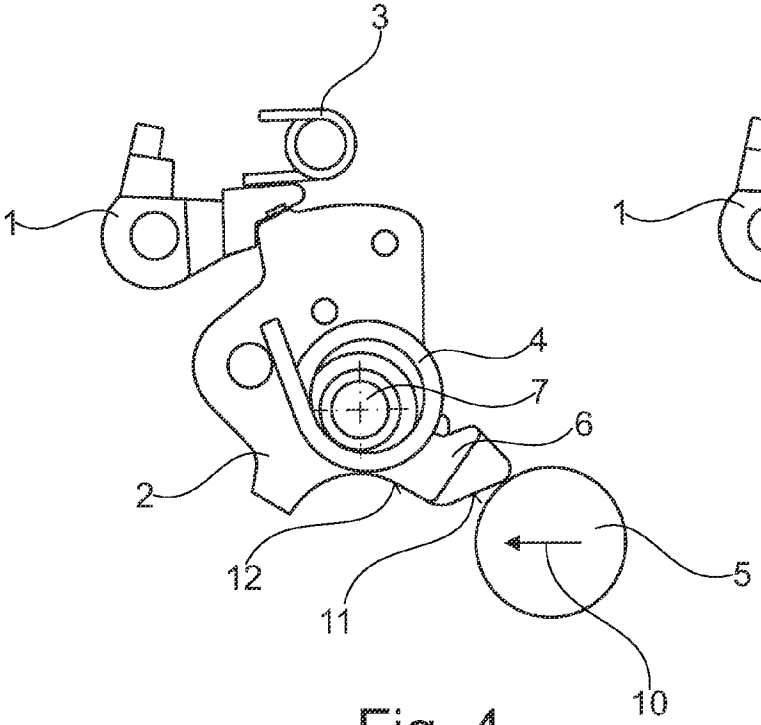
FIG. 4 is a view of the locking latch in the locked position, in which the locking of the sliding door is intended to be carried out by redirection of the resiliently loaded overload lever.

In FIGS. 4-6, it is shown how the locking of the sliding door can be carried out when the electromotive actuation mechanism for the rotary latch 2 fails. In this instance, the locking detent 1 remains in the locking position thereof so that the rotary latch 2 cannot assume the unlocking position illustrated in FIG. 2.

In order to lock the sliding door in the open position thereof, the guiding roller 5 of the sliding door moves according to FIG. 4 in the direction of the arrow 10 against an inclined approach portion 11 which is provided on the overload lever 6, whereby the overload lever 6, when the guiding roller 5 is moved further in the direction of the arrow 10, is lifted counter to the force of the overload spring 4 into the position illustrated in FIG. 5.

When the guiding roller 5 finally assumes the locking position which is illustrated in FIG. 6 and in which it is located in the receiving region 8, the overload lever 6 pivots downward as a result of the force applied by the overload spring 4 and closes the receiving region 8 so that the guiding roller 5 is securely locked in the rotary latch 2.

The unlocking of the guiding roller 5 and consequently the sliding door is carried out in the reverse order to the locking.

Figure 3:
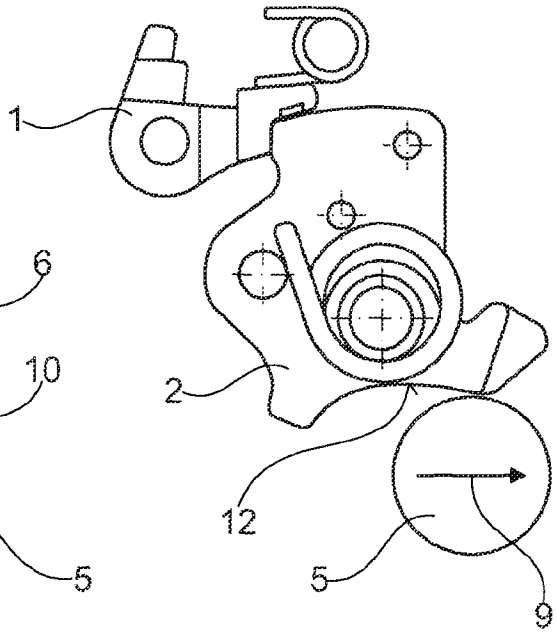
FIG. 3 is a view of the locking latch of FIG. 2, in which the locking latch is locked and the unlocking is carried out by the resiliently loaded overload lever.

If the pushing force applied to the sliding door in order to close the sliding door exceeds a specific magnitude, the guiding roller 5, as illustrated in FIG. 3, presses against the inner inclined portion 12 of the overload lever 6 so that it is lifted counter to the force of the overload spring 4. The guiding roller 5 can then move in the direction of the arrow 9 out of the receiving region 8.

When the guiding roller 5 has reached the unlocked position illustrated in FIG. 3, the sliding door can be pushed with little force into the locked position thereof.

As a result of the invention, there is thus provided a sliding door mechanism, by means of which, using an electromotive actuation mechanism which releases the locking detent 1 and consequently the rotary latch 2, the sliding door of a vehicle can be locked comfortably and with little force in the open position and can subsequently be unlocked again. However, in the event of failure of this system, it is further possible to lock and unlock the sliding door by means of the overload lever 6 by the pushing force which is applied to the sliding door being increased slightly in order to exceed a critical magnitude of the pushing force, at which the sliding door can then be locked and subsequently unlocked again.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A motor vehicle sliding door which can be moved back and forth by a sliding movement between open and closed positions, wherein, in order to lock the sliding door in the open position thereof, a mechanical door stop comprising a locking latch which has a receiving region for a catch element of the sliding door is provided, and wherein the locking latch can be released by a motorized actuation device, whereby the catch element is released, wherein the locking latch has a resiliently loaded overload lever, the overload lever is pivotably coupled to the locking latch and forms a lateral portion of the receiving region of the locking latch and power is not required for the overload lever to retain the catch element to hold the sliding door in the open position, wherein the overload lever pivots outward due to a sliding motion between the catch element relative to the locking latch, said sliding notion of the catch element being caused by a sliding motion of the sliding door while the locking latch is in a locked position and a specific pushing force of the sliding door is exceeded without activating the actuation device.

2. The sliding door as claimed in claim 1, wherein the overload lever pivots outward and releases the sliding door when the pushing force applied to the sliding door in the unlocking direction exceeds a specific magnitude.

3. The sliding door as claimed in claim 1, wherein the overload lever pivots outward and locks the sliding door when the pushing force applied to the sliding door in the locking direction exceeds a specific magnitude.

4. The sliding door as claimed in claim 1, wherein the locking latch is constructed as a rotary latch.

5. The sliding door as claimed in claim 4, wherein the rotary latch can be locked by a locking detent.

6. The sliding door as claimed in claim 5, further comprising an electromotive driver for actuating the locking detent.

7. The sliding door as claimed in claim 5, wherein the locking detent is pretensioned by a locking detent spring in a direction toward the locked position.

8. The sliding door as claimed in claim 1, wherein the overload lever pivots about an axis which extends transversely through the locking latch.

9. The sliding door as claimed in claim 1, wherein the locking latch comprises an overload spring which is constructed as a helical or spiral spring to provide resilient tension on the overload lever.

10. The sliding door as claimed in claim 1, wherein the overload lever has at a side thereof located inside the receiving region an inner inclined actuation portion for engaging the catch element.

11. The sliding door as claimed in claim 1, wherein the overload lever has, at a side thereof facing away from the receiving region, an inclined approach portion for engaging the catch element.

12. The sliding door as claimed in claim 1, wherein the catch element which is provided on the sliding door is constructed as a guiding roller which is round in cross section.

13. The sliding door as claimed in claim 12, wherein the guiding roller which acts as a catch element is rotatably supported on the sliding door.

14. The sliding door as claimed in claim 1, wherein the receiving region of the locking latch, which region serves to lock the guiding roller, is constructed in the manner of a circular arc.

15. A vehicle sliding door comprising:

a catch element;

a locking latch comprising a resiliently loaded overload lever pivotably coupled to the locking latch and having a receiving region for receiving the catch element to lock the sliding door in an open position, wherein power is not required for the overload lever to retain the catch element to hold the sliding door in the open position; and a motorized actuation device for releasing the locking latch from the catch element, wherein the overload lever pivots outward due to a sliding motion of the catch element relative to the locking latch, said sliding motion of the catch element being caused by a sliding motion of the sliding door while the locking latch is in a locked position with a pushing force of the sliding door and without activating the actuation device.

16. The sliding door as claimed in claim 15, wherein the overload lever forms a lateral portion of the receiving region of the locking latch and has an inclined portion that engages the catch element.

17. The sliding door as claimed in claim 15, wherein the overload lever pivots outward and releases the sliding door when the pushing force applied to the sliding door in the unlocking direction exceeds a specific magnitude.

18. The sliding door as claimed in claim 15, wherein the locking latch comprises an overload spring to provide resilient tension on the overload lever.

19. The sliding door as claimed in claim 15, wherein the catch element is constructed as a guiding roller which is round in cross section and wherein the receiving region has a shape of a circular arc.

20. A vehicle sliding door comprising:

a catch element;

a locking latch comprising a resiliently loaded overload lever pivotably coupled to the locking latch and having a receiving region for receiving the catch element to lock the sliding door in an open position, wherein power is not required for the overload lever to retain the catch element to hold the sliding door in the open position; and a motorized actuation device for releasing the locking latch from the catch element, wherein the overload lever pivots outward due to a sliding motion of the catch element relative to the locking latch, said sliding motion of the catch element being caused by a sliding motion of the sliding door while the locking latch is in a locked position with a pushing force of the sliding door causing the catch element to engage an inclined portion of the overload lever, wherein the locking latch is directly contacted by the catch element and is caused to undergo rotation when moving between an unlocked position and the locked position.

* * * * *